US009929524B1

(12) United States Patent
Rodgers

(10) Patent No.: US 9,929,524 B1
(45) Date of Patent: Mar. 27, 2018

(54) SYSTEM AND ARTICLES OF INTERCHANGEABLY CONNECTABLE PRE-WIRED SEGMENTS

(71) Applicant: Matthew Rodgers, Naples, FL (US)

(72) Inventor: Matthew Rodgers, Naples, FL (US)

( * ) Notice: Subject to any disclaimer, the term of this patent is extended or adjusted under 35 U.S.C. 154(b) by 0 days.

(21) Appl. No.: 15/632,034

(22) Filed: Jun. 23, 2017

Related U.S. Application Data

(60) Provisional application No. 62/354,217, filed on Jun. 24, 2016.

(51) Int. Cl.

| | |
|---|---|
| ***H01R 24/00*** | (2011.01) |
| ***H01R 33/08*** | (2006.01) |
| ***H01R 33/06*** | (2006.01) |
| ***H01R 13/703*** | (2006.01) |

(52) U.S. Cl.
CPC ..... *H01R 33/0827* (2013.01); *H01R 13/703* (2013.01); *H01R 33/06* (2013.01)

(58) Field of Classification Search
CPC ... H01R 33/0827; H01R 13/703; H01R 33/06
USPC ..... 439/660, 699.1, 699.2
See application file for complete search history.

(56) References Cited

U.S. PATENT DOCUMENTS

| | | | | |
|---|---|---|---|---|
| 5,788,518 | A * | 8/1998 | Wachter | H01R 25/142 362/287 |
| 6,079,992 | A * | 6/2000 | Kuchar | F21V 17/14 362/287 |
| 8,469,728 | B1 * | 6/2013 | Luksic | H01R 25/142 439/116 |
| 8,899,999 | B2 * | 12/2014 | Mackiewicz | F21S 8/038 439/118 |
| 2015/0049513 | A1 | 2/2015 | Haubach | |

OTHER PUBLICATIONS

Edge Lighting "Special Install Fast Jack Connectors" http://www.edgelighting.com/specs/fj_connectors_special_install.pdf?1498229509317.
Newnex, "USB 3.1 Type C Locking Cables" https://www.newnex.com/USB3.1-cables-locking.php.

* cited by examiner

*Primary Examiner* — Khiem Nguyen
(74) *Attorney, Agent, or Firm* — Grimes LLC

(57) ABSTRACT

Prewired, interchangeably connectible elements with mating electro-mechanical connectors for constructing a multitude of electrical apparatuses by forming load-bearing, electrical connections between the constituent elements thereof and a method of using such elements therefor.

20 Claims, 11 Drawing Sheets

Female
Male
Female
Male
Female
Male
Female
Male
Female
Male
θ
θ
θ
θ
θ
101
103
105
107
201
203
205
207
209
211
213
215
301
303
305
307
309
311
313
315
317
319
321
323

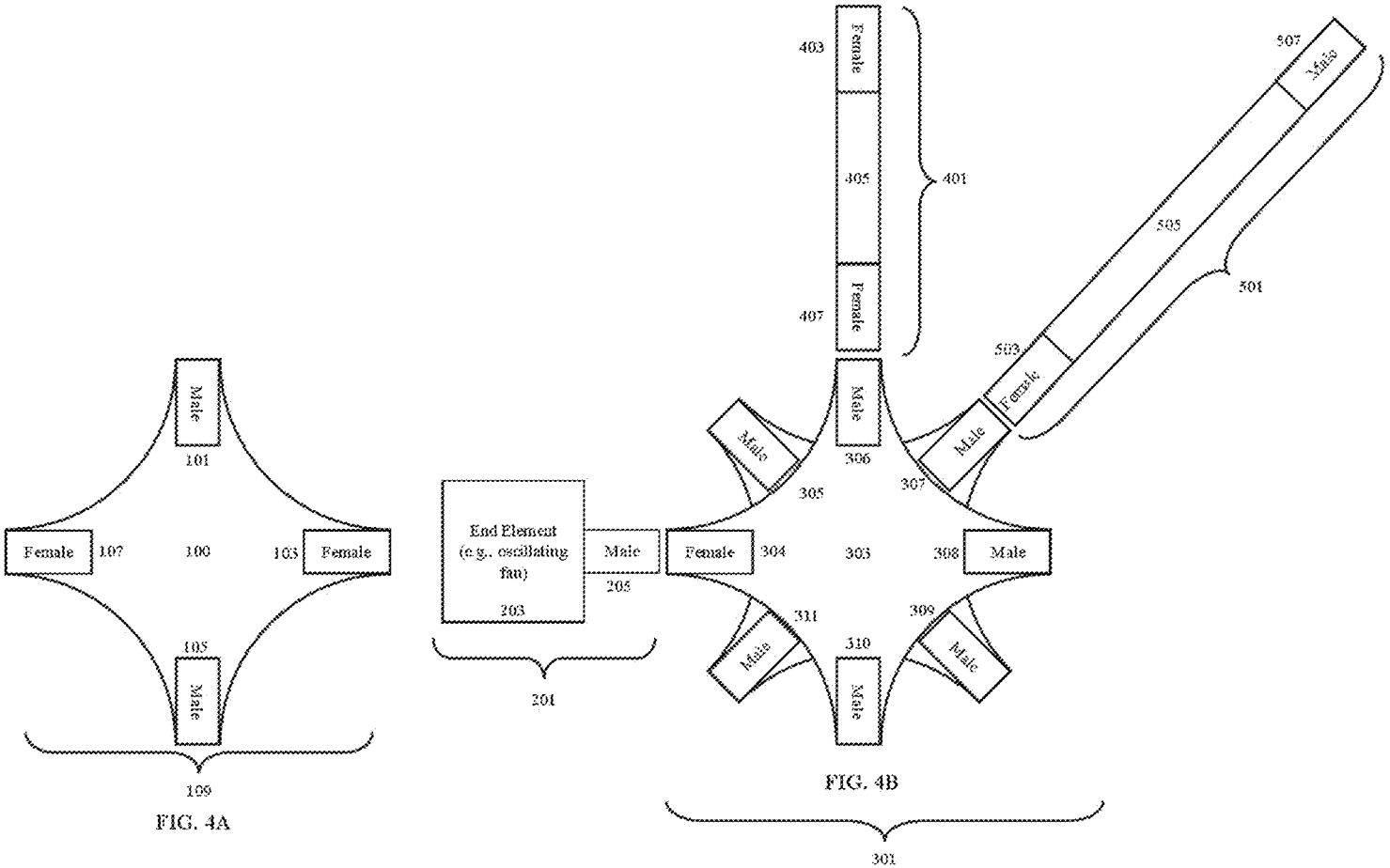
Female
Male
Female
Male
Female
Male
Male
Male

SYSTEM AND ARTICLES OF INTERCHANGEABLY CONNECTABLE PRE-WIRED SEGMENTS

CROSS-REFERENCE TO RELATED APPLICATION

This application claims the benefit of U.S. Provisional Application No. 62/354,217, filed on Jun. 24, 2016.

BACKGROUND OF THE INVENTION

Since the widespread introduction of the Edison incandescent light, structural electrical wiring has changed very little. Frustratingly, wall mounted electrical devices and ceiling mounted electrical devices typically follow widely divergent plug and receptacle standards.

In the United States, most appliances are wired with NEMA 1 (two-prong plugs, i.e., with no safety ground) or NEMA 5 (three-prong plugs, i.e., with a safety ground) plugs. Wall receptacles are typically wired with NEMA 5-15R outlets. Typical light bulbs still follow the Edison Screw socket standard first introduced in the early 1900s.

While the current NEMA/Edison Screw wiring system reliably provides an electrical connection to power devices, this system cannot be used to provide physical (i.e., load bearing) support. For example, a typical table lamp cannot be securely mounted using a NEMA connection. Rather, any force applied to the cord (e.g., if someone trips over the wiring) will immediately unplug the device or, possibly worse, knock the device over.

Elevated electrical devices such as wall sconces, recessed lighting, track lighting and ceiling fans follow a variety of standards, but typically need to be directly "hard wired" into a building's electrical system. For example, a typical ceiling fan with built-in lights needs to be directly wired into a ceiling fixture box. This is, in part, due to the inability of NEMA/Edison Screw plugs and outlets to bear a load since nearly all elevated electrical devices require structural support in mounting. Additionally, many elevated electrical devices are chosen for their aesthetic appeal which would be detracted by the presence of visible wiring. Typically, elevated electrical devices are mounted to a recessed structural element (e.g., a fixture box) which is, in turn, attached to a structural element of the building such as a ceiling beam or a wall stud.

Installing an elevated electrical device follows a routine pattern. First, an electrician mounts a recessed structural element (e.g., a fixture box) onto a structural support member (e.g., a wall stud). Next, the electrician wires internal connections within the structural element (e.g., a fixture box) into the building's electrical system. After the wall/ceiling material (e.g., drywall) is installed, an electrician will: (i) hard wire the desired elevated electrical device into the electrical wiring of the fixture box; and (ii) mount the device (e.g., by mounting a ceiling fan to a fan fixture box by means of support screws).

Unfortunately, replacing an elevated electrical device follows much of this same routine pattern. The old electrical device must be unmounted and unwired. Afterwards, a new electrical device must be remounted and rewired. Wiring a new elevated electrical device poses safety risks. In fact, because of safety and liability concerns, most elevated electrical device manufacturers and building insurance companies require that such wiring be limited to qualified licensed electricians. Such a requirement dramatically increases remodeling costs.

Many elevated electrical devices are also located high above the ground. This poses an additional safety risk as an electrician must work at a height. Many times, electricians must dangerously work atop a ladder—holding the electrical device in one hand while completing the electrical connection with the other hand.

Various devices disclose attempts to remedy the difficulties in replacing elevated electrical devices. For example, U.S. patent application Ser. No. 14/460,746 (Haubach) (hereinafter the "'746 application") discloses "Interchangeable Lighting Fixtures for Track and Wall Lighting System". However, the '746 application is limited to head lighting (i.e., not all elevated electrical devices such as ceiling fans). Additionally, the '746 application does nothing to promote interoperability with non-elevated electrical devices. For example, the electrical system discussed in the '746 application would be ill-suited to use in non-elevated electrical devices such as table lamps and floor lamps.

SUMMARY OF THE INVENTION

The present invention generally relates to a system of interchangeably connectible elements which are prewired and have mating electro-mechanical connectors. This system solves the dual problem of: (i) a universal connection standard for use in both elevated and non-elevated electrical devices; and (ii) simultaneously providing both electrical and load-bearing connections for an electrical device.

This System consists of a multitude of pre-wired, interchangeable elements including: (i) Linear Element Assemblies; (ii); Shaped Element Assemblies; (iii) Splitting Element Assemblies; (iv) Adaptor Element Assemblies; and (v) End Element Assemblies. Each of these broad categories are discussed below.

"Linear Element Assemblies" include connectors which may be used to electrically and mechanically join two other elements. Linear Element Assemblies come in a variety of lengths and may be rigid or flexible. At either end of a linear element are male or female coupling members. Linear Element Assemblies may come with either Male-Female, Male-Male or Female-Female coupling members. Internal wiring electrically connect the coupling members.

There are myriad possible implementations of coupling members, i.e., any coupling means which provides for both readily detachable electrical and structural connections. For example, a "lock and key" configuration or the use of a set screw or set pin and a hole. In the preferred embodiment, the coupling means also accomplishes a third purpose of providing a stabilizing connection to prevent undesired movement in or about the X, Y, and Z axes. In the preferred embodiment, the coupling means is accomplished through the use of a Coupling Assembly.

"Shaped Element Assemblies" include connectors which have been shaped in some way, e.g., at least one curve or angular "bend". Shaped elements come in a variety of shapes and lengths and may be rigid or flexible. At either end of a shaped element are male or female coupling members. Shaped elements may come with either Male-Female, Male-Male or Female-Female coupling members. Internal wiring electrically connect the coupling members.

"Splitting Element Assemblies" include flexible and rigid connectors which join three or more elements. For example, a "T" element could be used to electrically and mechanically join three elements while a "6 port hub" element could be used to electrically and mechanically join six elements. Splitting elements come in a variety of configurations and with a variety of male or female coupling members. Internal wiring electrically connect the coupling members.

"Adaptor Assemblies" include a variety of devices which: (i) connect traditional electrical systems to the new system disclosed in this application; or (ii) connect various size/type couplings to other size/type couplings within the new system disclosed in this application. For example:

(i) one form of adaptor assembly could be used to connect a NEMA 1 plug to the new system disclosed in this application;

(ii) one form of adaptor assembly could be used to connect a NEMA 5-15R socket to the new system disclosed in this application;

(iii) one form of adaptor assembly could be used to connect an Edison Screw device (e.g., a standard light bulb) to the new system disclosed in this application;

(iv) one form of adaptor assembly could be used to "hard wire" the new system into the wiring of a structure; and (v) one form of adaptor assembly could be used to convert a 12 mm size Coupling Assembly used in the preferred embodiment of the new system disclosed in this application with a 16 mm size Coupling Assembly in the preferred embodiment of the new system disclosed in this application.

Because the present invention is designed to be compatible with standard wiring voltage and frequency (i.e., 120 VAC at 60 Hz) internal wiring is used to connect the pins or terminals of the coupling members to the "old" system as needed.

"End Element Assemblies" include all powered electromechanical devices. Light bulbs, cell phone chargers, table lamps, ceiling fans and space heaters are all examples of powered electromechanical devices.

Various elements can be embedded in floors, walls, ceilings, or even in furniture. For example, a linear element assembly could run down a hollowed out leg of a desk and into a male coupling member installed in the floor. Another coupling member could be embedded in the desk underneath a detachable, aesthetically pleasing veneer. A user of the present invention could remove the veneer, and complete the electrical circuit and the physical connection by attaching a table lamp end element to the embedded coupling member. In this way, a user of the present invention could have a desk lamp assembly without any visible wires.

Because of the relatively small size of the coupling members in the preferred embodiment, male coupling members (i.e., sockets) can be recessed and hidden behind veneers, covering plates, spring covers and similar devices. For example, in a home designed with NEMA sockets, unsightly wall outlets are often hidden behind furniture. In a home designed using the present invention, recessed male sockets can be hidden in any area of the home without disrupting the room's aesthetic. In fact, because of their small size and ability to be camouflaged, dozens of recessed male sockets can be installed in a single room—all without any visible wiring.

The coupling members can come in a variety of styles depending on the precise application. Coupling members can come in two (2) pin varieties (primarily for lighting) or three (3) pin varieties to accommodate electromechanical devices requiring a ground. The outer housing of the coupling members can also come in a variety of diameter sizes to accommodate greater or lesser load bearing requirements. The outer housing can also come in a waterproof connector for use in high moisture or outdoor applications. In the preferred embodiment the coupling members contain some degree of threading (e.g., sufficient to accommodate a "half turn").

In the preferred embodiment, the coupling members are manufactured in a standard 16 mm diameter size. Experimentation has shown that this size is able to sustain most common load bearing requirements at a minimum manufacturing cost. Additionally, the pin-diameter and the internal wiring gage have been chosen to handle typical home/office electrical requirements (e.g., 120 VAC, 60 Hz at a maximum 15 A load requirements) and electrical connectivity requirements.

Because pre-wired elements can be manufactured in a variety of outer materials and a variety of shapes and sizes, end users have the flexibility to design their own artistic lighting and other electrical creations. For example, an end user who enjoys an "industrial design" aesthetic could combine a variety of right-angle shaped elements made out of faux-rusted metal to create an intricate "steampunk" style wall sconce. Similarly, an end user who enjoys a "modernist" aesthetic could combine a chromed spherical splitting element with chromed ridged linear elements to create a "sputnik" style chandelier. The possibilities for such aesthetics are limited only by the imagination of those using the present invention.

End users can easily "swap" various segments for repairs and/or for aesthetic changes—all without requiring any rewiring, tools or special knowledge. In fact, because all of the wiring is self-contained, a non-electrician could safely interchange elements with no greater degree of risk than plugging in a standard electrical plug into a socket. Thus, a building owner could make repairs or improvements without having to employ an electrician and without jeopardizing insurance coverage from "do it yourself" mistakes.

Take, for example, a homeowner who wishes to replace a chandelier. In a traditional lighting system, the homeowner needs to remove the ceiling mounting plate, unwire the old chandelier, detach the old chandelier's physical support members, then detach the old chandelier. Only after this process is done could the homeowner install a new chandelier by following these same, tedious steps in reverse. Again, this time-consuming process poses a risk of electrocution or falling to the untrained homeowner and could violate the homeowner's insurance policy.

This is in stark contrast to a homeowner who made use of the present invention. Such a homeowner could simply detach both the electrical and the physical connection by detaching the coupling member from the adaptor element assembly "hard wired" into the ceiling. The homeowner could then attach a new chandelier by connecting the new chandelier's coupling element member to the never-disturbed adaptor element assembly "hard wired" into the ceiling.

In the example above, the present invention would require an initial installation similar to the traditional wiring system insofar as an electrician would need to: (i) mount a recessed structural element (e.g., a fixture box) onto a structural support member (e.g., a wall stud); and (ii) wire internal connections within the structural element (e.g., a fixture box) into the building's electrical system. Critically, this is where the similarities during an initial installation would end. In a traditional system, the electrician would next be forced to dangerously scale a ladder while carrying a heavy chandelier, ceiling fan or other elevated electrical device. Using the instant invention, however, the electrician could easily install only the "hard wire" adaptor element assembly by making the requisite structural and electrical connections to the fixture box. The electrician (or the building owner) could then quickly and easily attach the desired elevated electrical device without even needing tools.

The present system also makes it much easier for lighting manufacturers to package and ship lighting fixtures to customers. For example, in shipping a traditionally wired "Sputnik" type chandelier, each "arm" of the fixture is hard wired to the main chandelier body. This means that the entire assembly must be shipped in a bulky and fragile way, i.e., pre-wired (and possibly pre-assembled). Using the present invention, a lighting manufacturer could ship a "Sputnik" style splitting element assembly and multiple "Sputnik" style linear element assemblies (i.e., "arms") as separate, pre-wired elements. A customer then could easily assembly the chandelier him- or herself without having to do any wiring by simply connecting the "arms" to the "body". In this way, the packaging footprint for lighting companies could be reduced, thereby minimizing shipping costs and the risk of damage during transportation.

In one possible embodiment, an electrical control system can used in connection with one or more elements (e.g., an end element which is "hard wired" into a home's electrical system) to regulate the flow of electricity to connected elements. For example, a TRIAC (i.e., a dimmer switch) could be electrically connected to a wall-mounted end element to adjust the brightness of a table lamp end element.

In one possible embodiment, a computerized electrical control system can be used in connection with one or more elements (e.g., an end element assembly which is "hard wired" into a home's electrical system) to regulate the flow of electricity to connected elements. For example, end element assemblies could contain embedded microcontrollers which can receive power-regulating commands via a remote signal (e.g., Wi-Fi, Bluetooth, etc.). In one possible embodiment, such computerized elements could be designed to "link" together in such a way as to share information/coordinate commands. For example, various computerized elements could send power usage information to one another while simultaneously coordinating "light dimming" commands to uniformly lower a room's ambient lighting.

BRIEF DESCRIPTION OF THE DRAWINGS

FIG. 4A is block diagram of a 4-way splitting element assembly.

FIG. 4B is a block diagram of an 8 way splitting element assembly as it could be connected to several other elements.

FIG. 1 DRAWING REFERENCE NUMBER KEY

100 Female Coupling Assembly
111 Telescoping Coupling Shaft
113 Female Electrical Receptacle
114 Female Electrical Contact
115 Coupling Groove
117 Female Flange
119 Female Flange Surface
121 Collar
123 Collar Lip
125 Inner Collar Surface
127 Inner Collar Threads
129 Female Wiring Pin
131 Coupling Shaft
133 Internal Female Wiring
135 Female Coupling Surface
137 Collar Hole
200 Male Coupling Assembly
211 Inner Male Coupling Surface
213 Male Electrical Pin
215 Coupling Tongue
217 Male Coupling Lip
219 Male Coupling Threads
221 Male Flange
223 Male Flange Surface
225 Male Wiring Pin
227 Internal Male Wiring
229 Male Shaft
231 Male Coupling Opening
232 Male Exterior Shaft Surface
300 Coupling Assembly

DETAILED DESCRIPTION OF THE INVENTION

Figure 1:
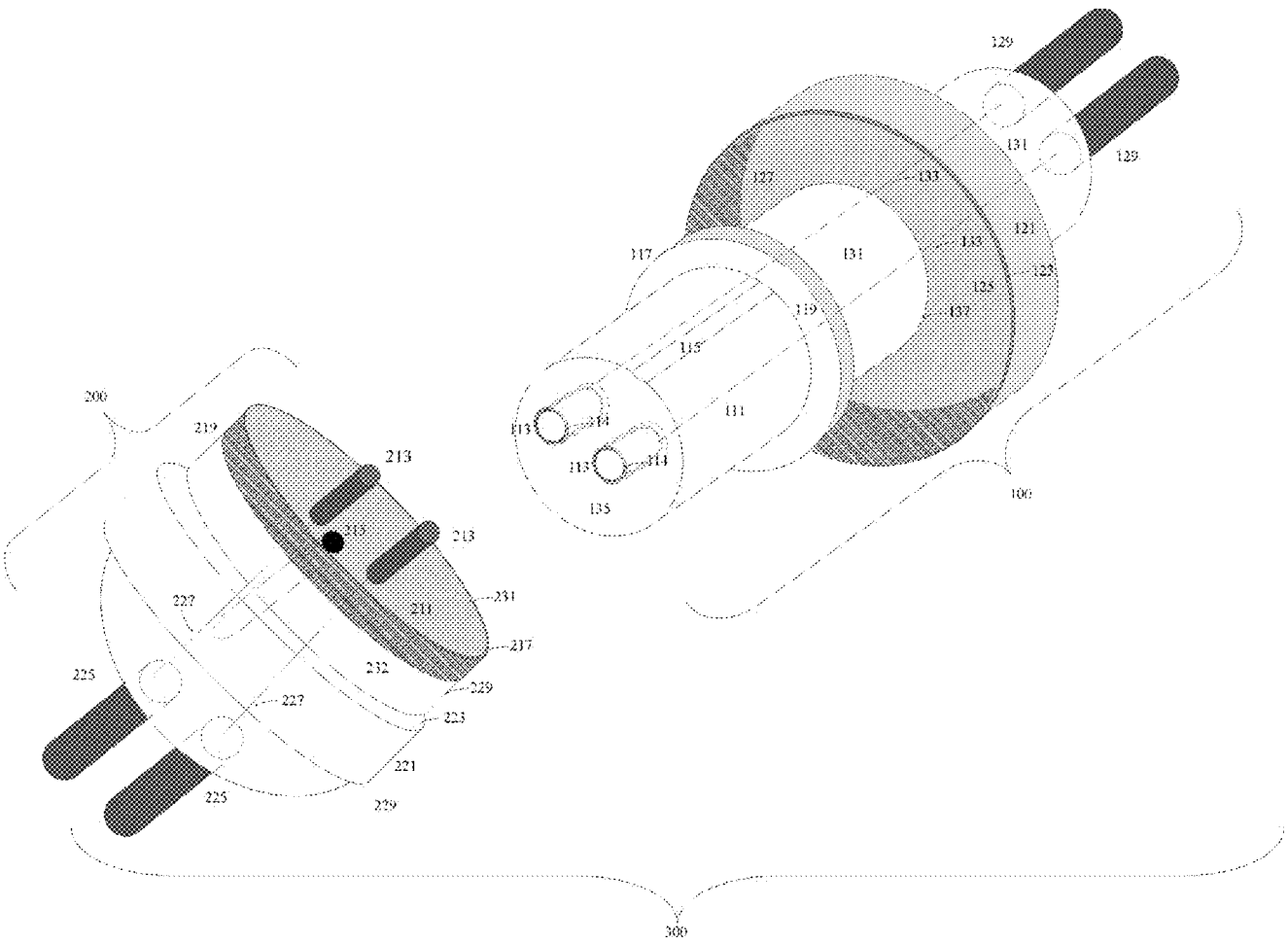
FIG. 1 is a perspective view of the preferred embodiment of the Coupling Assembly.

The present invention discloses a system of interchangeably connectible elements which are prewired and have mating electro-mechanical connectors. FIG. 1 shows one possible embodiment of the mating electro-mechanical connectors, namely, an ungrounded (i.e., two pin) Coupling Assembly 300.

The Coupling Assembly 300 is comprised of a mating Female Coupling Assembly 100 and a Male Coupling Assembly 200.

The Female Coupling Assembly 100 comprises a Coupling Shaft 131 attached to a Telescoping Coupling Shaft 111. In the preferred embodiment, the Telescoping Coupling Shaft 111 is formed out of an insulating material. A protruding Female Flange 117 defines the boundary between the Coupling Shaft 131 and the Telescoping Coupling Shaft 111. The Female Flange 117 has a Female Flange Surface 119 such that the plane of the Female Flange Surface 119 is perpendicular to the plane defined by the Telescoping Coupling Shaft 111. A Coupling Groove 115 extends along the cylindrical surface of the Telescoping Coupling Shaft 111. Two Female Electrical Receptacles 113 are formed within the Telescoping Coupling Shaft 111 and extend outward to the Female Coupling Surface 135. Inside each Female Electrical Receptacle 113 is a Female Electrical Contact 114. Each Female Electrical Receptacle 113 is connected to one of the Female Wiring Pins 129 by means of Internal Female Wiring 133. The Female Wiring Pins 129 extend outwards from the Coupling Shaft 131. A Collar 121 contains a Collar Hole 137 dimensionally sized such that the Collar Hole 137 is larger than the Coupling Shaft 131 but smaller than the Female Flange 117. In this way, the Collar 121 is able to slide along the length of the Coupling Shaft 131 until its motion is arrested by the Female Flange 117. The Collar 121 has an Inner Collar Surface 125 and a Collar Lip 123 such that the plane defined by the Collar Lip 123 is perpendicular to the plane defined by the Collar 121. Some degree of threading is formed in the Inner Collar Surface 125. In the preferred embodiment, this threading is in the form of Inner Collar Threads 127.

The Male Coupling Assembly 200 is formed by a Male Shaft 229 having a Male Exterior Shaft Surface 232 and a Male Coupling Opening 231. Protruding out of the Male Shaft 229 is a Male Flange 221 such that the plane defined by the Male Flange 221 is perpendicular to the plane defined by the Male Shaft 229. The Male Coupling Opening 231 is dimensionally sized to telescopingly accommodate the Telescoping Coupling Shaft 111. One end of the Male Coupling Opening 231 is open to receive the Telescoping Coupling Shaft 111 while the other end is plugged by an Inner Male Coupling Surface 211. In the preferred embodiment, the Inner Male Coupling Surface 211 is formed out of an electrically insulating material. Extending outwardly from the Inner Male Coupling Surface 211 are two Male Electrical Pins 213. The Male Electrical Pins 213 are dimensionally sized to fit inside the Female Electrical Receptacles 113 of the Female Coupling Assembly 100. Each Male Electrical Pin 213 is connected to one of the Male Wiring Pins 225 by means of Internal Male Wiring 227. The Male Wiring Pins 225 extend outwards from the Male Coupling Shaft 131. A Coupling Tongue 215 also extends outwardly from the Inner Male Coupling Surface 211. The Coupling Tongue 215 is dimensionally sized to slide within the Coupling Groove 115 of the Female Coupling Assembly 100. Some portion of the Male Exterior Shaft Surface 232 contains some degree of threading. In the preferred embodiment, Male Coupling Threads 219 cover at least some portion of the Male Exterior Shaft Surface 232 between the Male Flange 221 and the Male Coupling Lip 217.

The Female Coupling Assembly 100 detachably engages with the Male Coupling Assembly 200 to form the Coupling Assembly 300. In doing so, the Telescoping Coupling Shaft 111 slides into the Male Coupling Opening 231 such that the Coupling Tongue 215 of the Male Coupling Assembly 200 slides inside of the Coupling Groove 115 and such that the Male Electrical Pins 213 slide inside the Female Electrical Receptacles 113 and touch the Female Electrical Contacts 114. Thus, an unbroken electrical connection is formed from the Female Wiring Pins 129 through the Internal Female Wiring 133 and the Female Electrical Contacts 114 to the Male Wiring Pins 225 through the Male Internal Male Wiring 227 and the Male Electrical Pins 213.

When the Female Coupling Assembly 100 and the Male Coupling Assembly 200 are engaged, the Female Flange Surface 119 and the Male Coupling Lip 217 align and frictionally engage one another. The Collar 121 may then be slid along the Coupling Shaft 131 and rotated such that the Inner Collar Threads 127 on the Female Coupling Assembly 100 screw onto the Male Coupling Threads 219 on the Male Coupling Assembly 200. The Collar 121, the Inner Collar Threads 127, the Male Coupling Threads 219 and the Male Flange 221 are all dimensionally sized such that the Male Flange 221 and the Collar Lip 123 frictionally engage one another at the same point in which the Collar 121 is arrested by the Female Flange Surface 119. In this way, the torque applied to the Collar 121 in screwing the Inner Collar Threads 127 onto the Male Coupling Threads 219 applies a force to amplify the frictional engagement between both: (i) the Female Flange Surface 119 and the Male Coupling Lip 217; and (ii) the Collar Lip 123 and the Male Flange Surface 223.

Figure 2A:
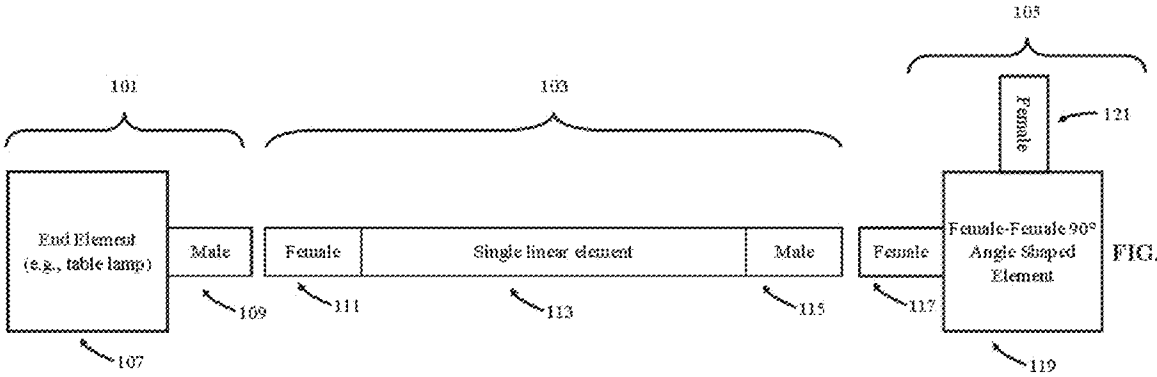
FIG. 2A is a block diagram of a single linear element assembly as it could be used to connect two other elements.

FIG. 2A shows one possible configuration of various elements, namely: (i) an End Element Assembly 101 comprising an End Element 107 having a Male Coupling Assembly 109; (ii) a Linear Element Assembly 103 comprising a Linear Element Body 113 having a Female Coupling Assembly 111 at one end and a Male Coupling Assembly 115 at the other end; and (iii) a Shaped Element Assembly 105 comprising a Shaped Element Body 119 having a first Female Coupling Assembly 117 at one end and a second Female Coupling Assembly 121 at the other end. The End Element Assembly 101 may be detachably, electromechanically connected to the Shaped Element Assembly 105 by means of the Linear Element Assembly 103. This is accomplished by detachably connecting the Male Coupling Assembly 109 to the Female Coupling Assembly 111 and by detachably connecting the Male Coupling Assembly 115 to the Female Coupling Assembly 117.

Figure 2B:
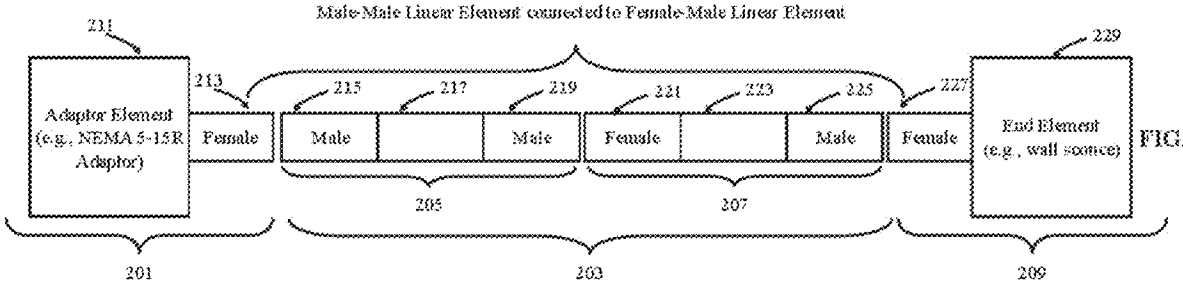
FIG. 2B is block diagram of two linear element assemblies as they could be used to connect two other elements.

FIG. 2B shows one possible configuration of various elements, namely: (i) an Adaptor Element Assembly 201 comprising an Adaptor Element 211 having a Female Coupling Assembly 213; (ii) a first Linear Element Assembly 205 comprising a Linear Element Body 217 having a first Male Coupling Assembly 215 at one end and a second Male Coupling Assembly 219 at the other end; (iii) a second Linear Element Assembly 207 comprising a Linear Element Body 223 having a Female Coupling Assembly 221 on one end and a Male Coupling Assembly 225 at the other end; and (iv) an End Element Assembly 209 comprising an End Element 229 having a Female Coupling Assembly 227. The two Linear Element Assemblies 205 and 207 may be joined together to form a Linear Element Chain 203 by means of connecting the Male Coupling Assembly 219 to the Female Coupling Assembly 221. The Adaptor Element Assembly 201 may be detachably, electromechanically connected to the End Element Assembly 229 by means of connecting the Female Coupling Assembly 213 to the Male Coupling Assembly 215, connecting the Male Coupling Assembly 219 to the Female Coupling Assembly 221 and the Male Coupling Assembly 225 to the Female Coupling Assembly 227.

Figure 2C:
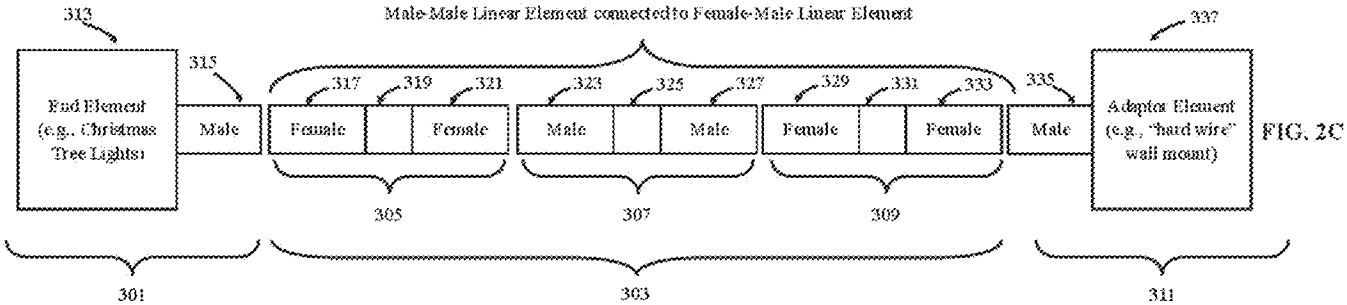
FIG. 2C is a block diagram of three linear element assemblies as they could be used to connect two other elements.

FIG. 2C shows one possible configuration of various elements, namely: (i) an End Element Assembly 301 comprising an End Element 313 having a Male Coupling Assembly 315; (ii) a first Linear Element Assembly 305 comprising a Linear Element Body 319 having a first Female Coupling Assembly 317 at one end and a second Female Coupling Assembly 321 at the other end; (iii) a second Linear Element Assembly 307 comprising a Linear Element Body 325 having a first Male Coupling Assembly 323 on one end and a second Male Coupling Assembly 327 on the other end; (iv) a third Linear Element Assembly 309 comprising a Linear Element Body 331 having a first Female Coupling Assembly 329 at one end and a second Female Coupling Assembly 333 at the other end; and (v) an Adaptor Element Assembly 311 comprising an Adaptor Element 337 having a Male Coupling Assembly 335. The three Linear Element Assemblies 305, 307 and 309 may be joined together to form a Linear Element Chain 303 by means of connecting the Female Coupling Assembly 321 to the Male Coupling Assembly 323 and the Male Coupling Assembly 327 to the Female Coupling Assembly 329. The End Element Assembly 301 may be detachably, electromechanically connected to the Adaptor Element Assembly 311 by means of connecting the Male Coupling Assembly 315 to the Female Coupling Assembly 317 of the Linear Element Chain 303 and the Female Coupling Element 333 of the Linear Element Chain 303 to the Male Coupling Assembly 335.

Figures 3A, 3B, 3C:
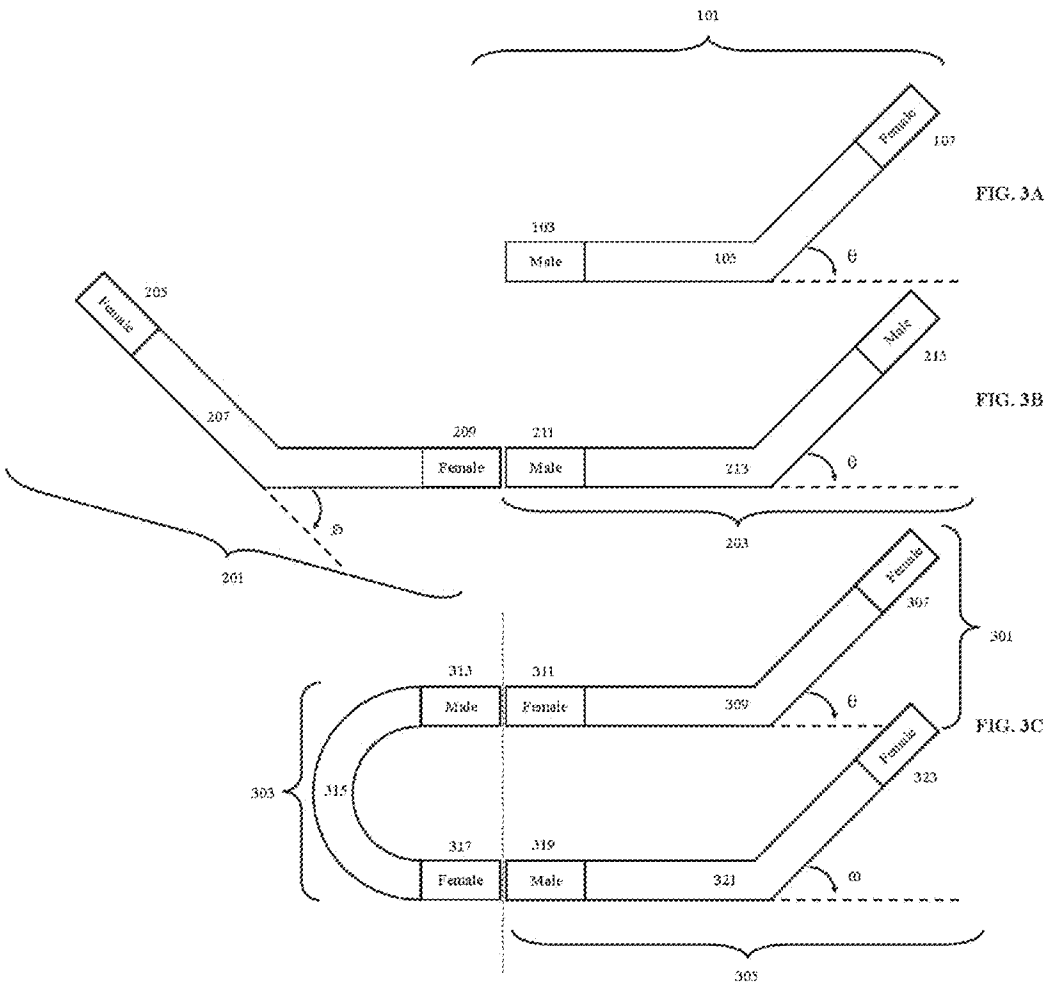
FIG. 3A is a block diagram of a single shaped element assembly.
FIG. 3B is a block diagram of two connected shaped element assemblies.
FIG. 3C is a block diagram of three connected shaped element assemblies.

FIG. 3A shows a single Shaped Element Assembly 101 comprising a Shaped Element Body 105 having a Male Coupling Assembly 103 at one end and a Female Coupling Assembly 107 at the other end.

FIG. 3B shows one possible configuration of various elements, namely: (i) a first Shaped Element Assembly 201 comprising a Shaped Element Body 207 having a first Female Coupling Assembly 205 at one end and a second Female Coupling Assembly 209 at the other end; and (ii) a second Shaped Element Assembly 203 comprising a Shaped Element Body 213 having a first Male Coupling Assembly 211 at one end and a second Male Coupling Assembly 215 at the other end. The first Shaped Element Assembly 201 can be detachably, electromechanically connected to the second Shaped Element Assembly 203 by connecting the Female Coupling Assembly 209 to the Male Coupling Assembly 211.

FIG. 3C shows one possible configuration of various elements, namely: (i) a first Shaped Element Assembly 301 comprising a Shaped Element Body 309 having a first Female Coupling Assembly 307 at one end and a second female Coupling Assembly 311 at the other end; (ii) a second Shaped Element Assembly 303 comprising a Shaped Element Body 315 having a Male Coupling Assembly 313 at one end and a Female Coupling Assembly 317 at the other end; and (iii) a third Shaped Element Assembly 305 comprising a Shaped Element Body 321 having a Male Coupling Assembly 319 at one end and a Female Coupling Assembly 323 at the other end. The three Shaped Element Assemblies 301, 303 and 305 may be detachably, electromechanically connected by means of connecting the Female Coupling Assembly 311 to the Male Coupling Assembly 313 and the Female Coupling Assembly 317 to the Male Coupling Assembly 319.

FIG. 4A shows a four-way Splitting Element Assembly 109 comprising a Splitting Element Body 100 having two Male Coupling Elements 101 and 105 and two Female Coupling Elements 103 and 107.

FIG. 4B shows one possible configuration of various elements, namely: (i) an End Element Assembly 201 comprising an End Element 203 having a Male Coupling Assembly 205; (ii) an eight-way Splitting Element Assembly 303 having seven Male Coupling Assemblies 305, 306, 307, 308, 309, 310 and 311 and one Female Coupling Assembly 304; (iii) a first Linear Element Assembly 401 comprising a Linear Element Body 405 having a first Female Coupling Assembly 403 at one end and a second Female Coupling Assembly 407 on the other end; and (iv) a second Linear Element Assembly 501 comprising a Linear Element Body 505 having a Female Coupling Assembly 503 on one end and a Male Coupling Assembly 507 on the other end. The End Element Assembly 201, the eight-way Splitting Element Assembly 301, and the two Linear Element Assemblies 401 and 501 may be detachably, electromechanically connected by means of connecting the Male Coupling Assembly 205 to the Female Coupling Assembly 304, the Female Coupling Assembly 407 to the Male Coupling Assembly 306 and the Male Coupling Assembly 307 to the Female Coupling Assembly 503.

Figure 5:
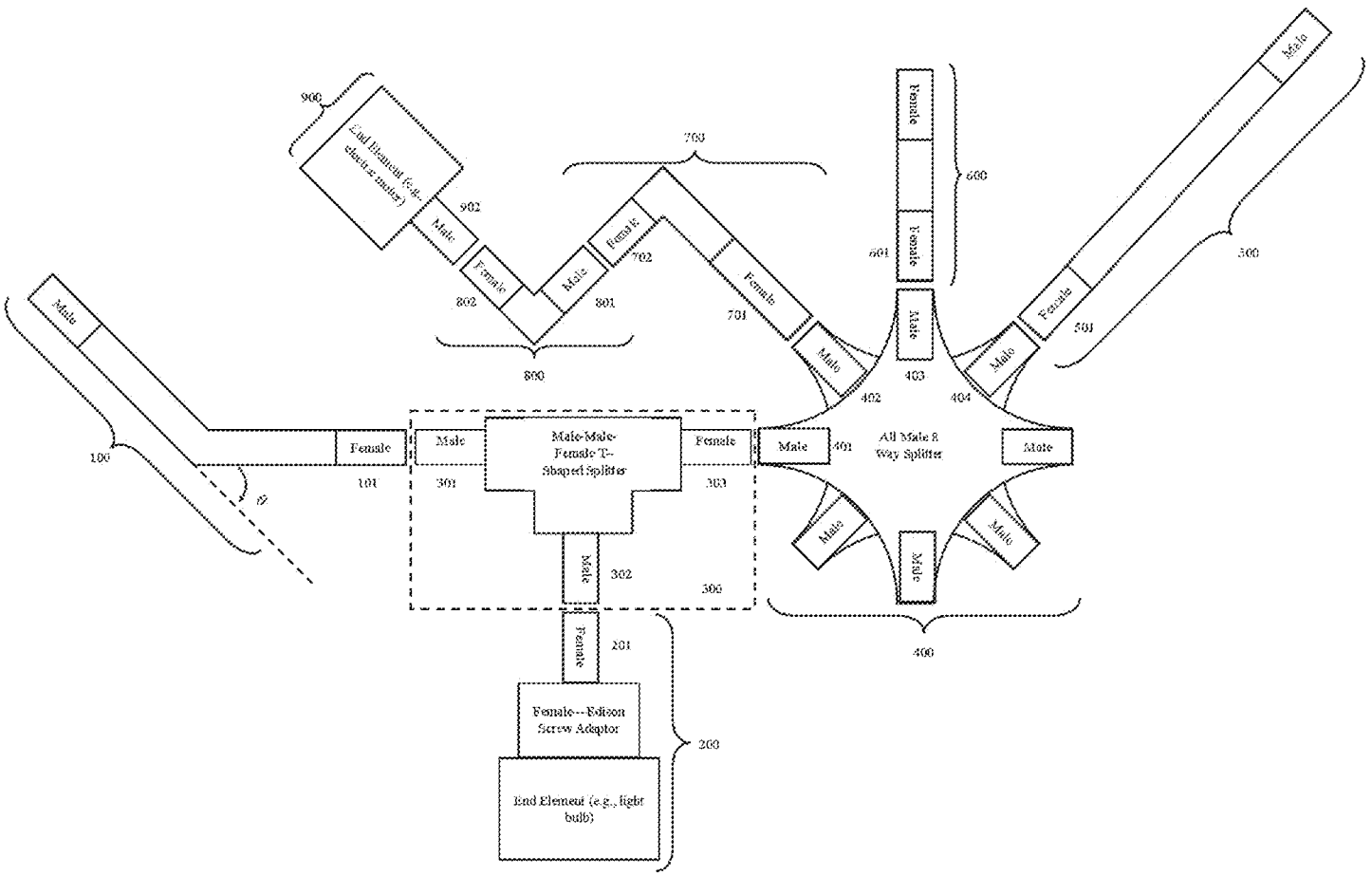
FIG. 5 is a block diagram of several elements as they could be connected together.

FIG. 5 shows one possible configuration of various elements, namely: (i) a first Shaped Element Assembly 100 having, inter alia, a Female Coupling Assembly 101; (ii) a first End Element Assembly 200 having, inter alia, a Female Coupling Assembly 201; (iii) a first Splitting Element Assembling having, inter alia, a first Male Coupling Assembly 301, a second Male Coupling Assembly 302 and a Female Coupling Assembly 303; (iv) a second Splitting Element Assembly having, inter alia, four male Coupling Assemblies 401, 402, 403 and 404; (v) a first Linear Element Assembly 500 having, inter alia, a Female Coupling Assembly 501; (vi) a second Linear Element Assembly 600 having, inter alia, a Female Coupling Assembly 601; (vii) a second Shaped Element Assembly 700 having, inter alia, a first Female Coupling Member 701 and a second Female Coupling Member 702; (viii) a third Shaped Element Assembly 800 having, inter alia, a Male Coupling Member 801 and a Female Coupling Member 802; and (ix) a second End Element Assembly 900 having, inter alia, a Male Coupling Member 902. Each of the nine element assemblies discussed above (i.e., 100, 200, 300, 400, 500, 600, 700, 800 and 900) may be detachably, electromechanically connected by means of connecting the Female Coupling Assembly 101 to the Male Coupling Assembly 301 and the Female Coupling Assembly 201 to the Male Coupling Assembly 302 and the Female Coupling Assembly 303 to the Male Coupling Assembly 401 and the Male Coupling Assembly 404 to the Female Coupling Assembly 501 and the Male Coupling Assembly 403 to the Female Coupling Assembly 601 and the Male Coupling Assembly 402 to the Female Coupling Assembly 701 and the Female Coupling Assembly 702 to the Male Coupling Assembly 801 and the Female Coupling Assembly 802 to the Male Coupling Assembly 902.

Figure 6:
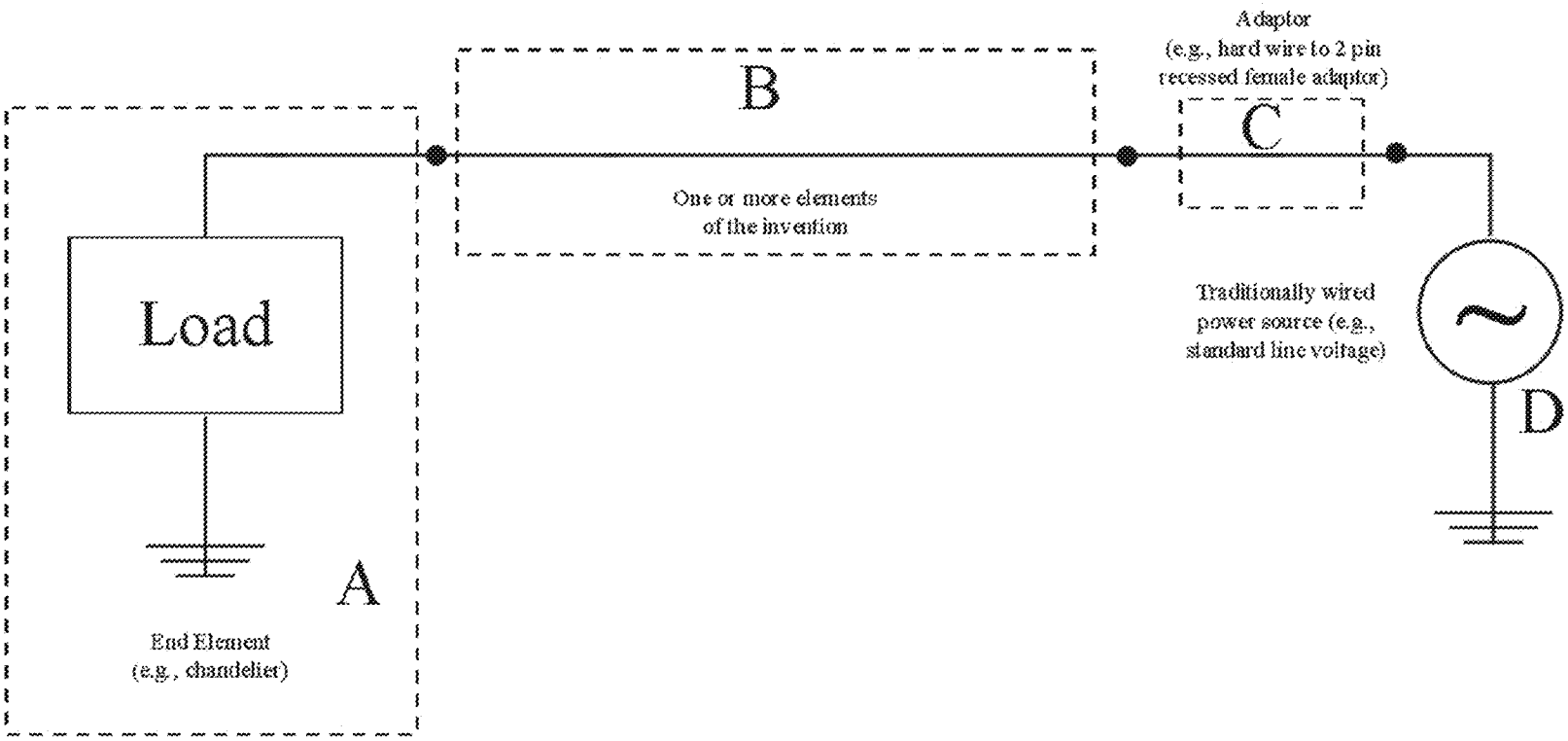
FIG. 6 is an electrical circuit diagram representing an end element assembly (powered device) connected to a linear element assembly which is connected to an adaptor assembly which is connected to a power source.

FIG. 6 shows an electrical circuit diagram representing the electrical equivalent of connecting an End Element Assembly (represented by the enclosed area "A") to one or more Linear Element Assemblies (represented by the enclosed area "B") to an Adaptor Element Assembly (represented by the enclosed area "C") which is connected to a power source (e.g., a home 120 VAC electrical supply) (represented by the power source "D").

Figure 7:
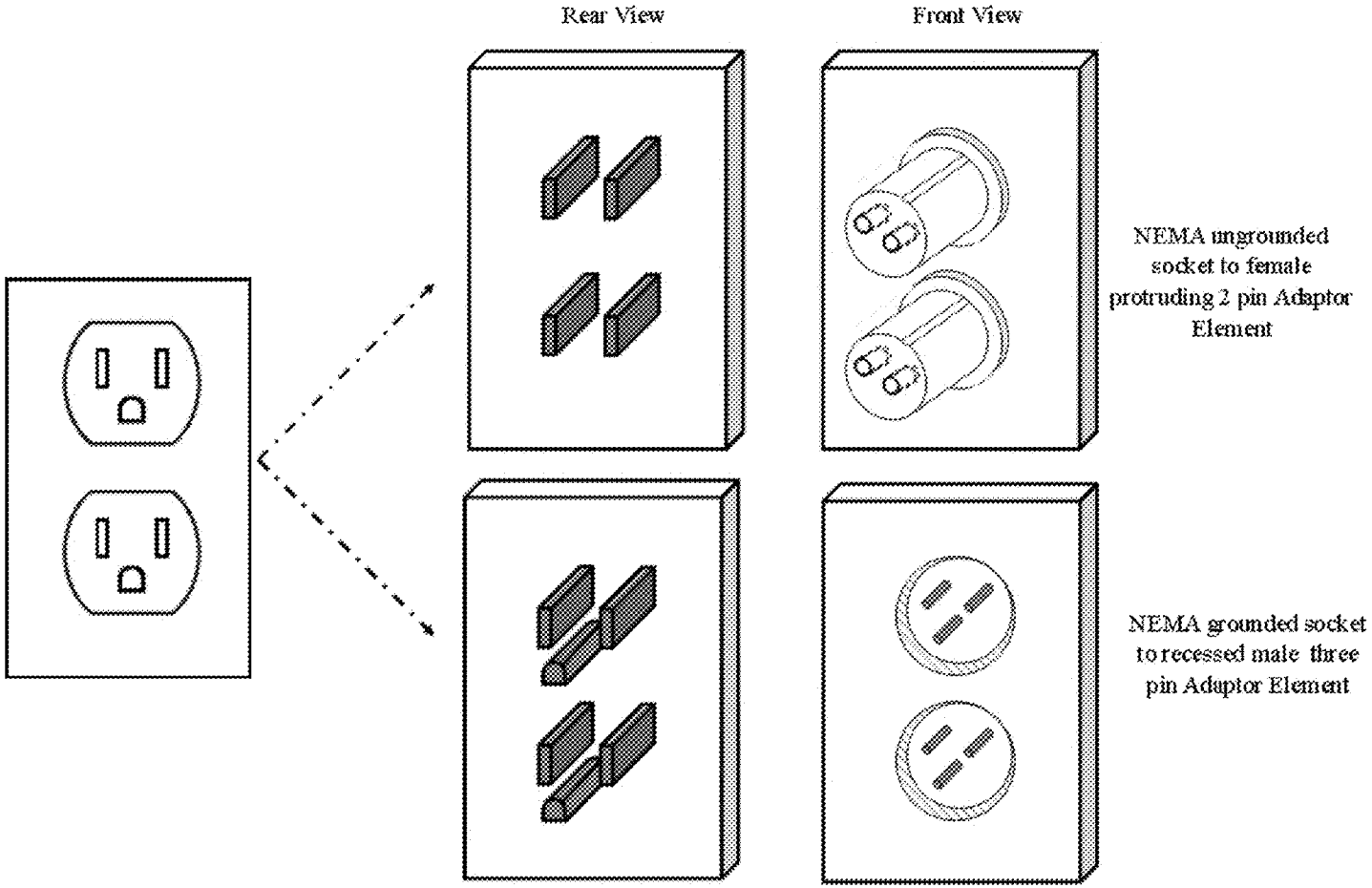
FIG. 7 is a sketch showing the rear and front views of several possible NEMA adaptor assemblies.

FIG. 7 shows a pictographic representation of front and back views of possible Adaptor Assemblies, i.e., a NEMA 1 (i.e., ungrounded) to female two pin Adaptor Assembly and a NEMA 5 (i.e., grounded) to male three pin Adaptor Assembly.

Figure 8:
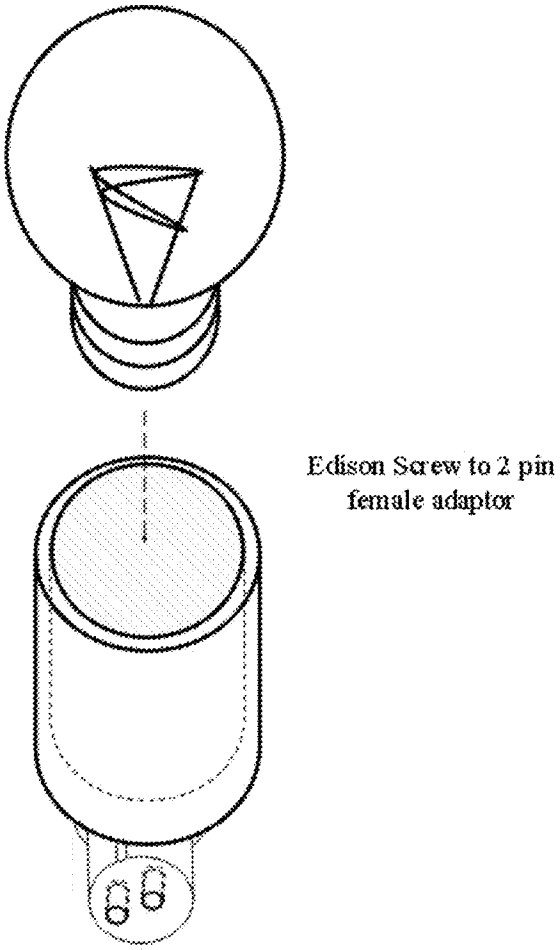
FIG. 8 is a sketch showing a possible Edison Screw adaptor assembly.

FIG. 8 shows a pictographic representation of an Edison Screw to two pin female Adaptor Assembly.

Figure 9:
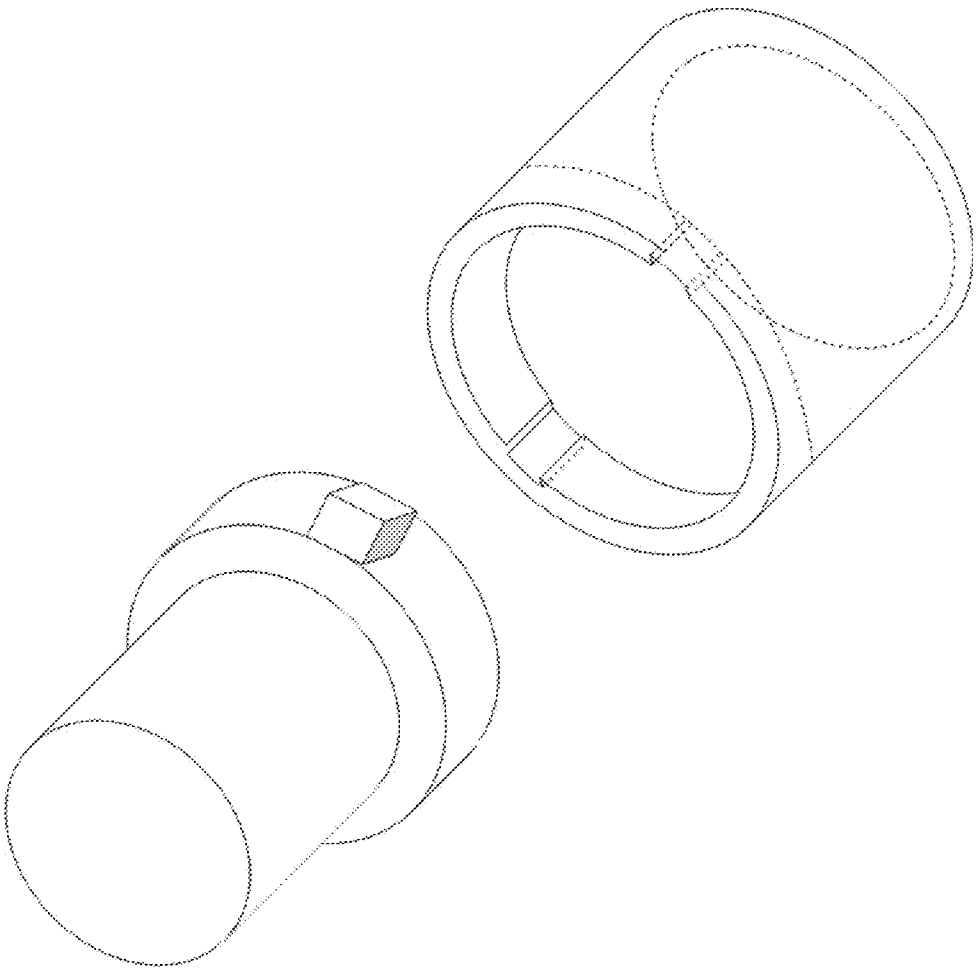
FIG. 9 is a sketch showing one of the myriad possible alternative coupling means for making the electromechanical connection between various prewired elements.

FIG. 9 shows an alternative embodiment of a possible physical component of a coupling member using a "lock and key" provided by a Protrusion 101 which slides into a Notch 102 such that the Key 105 fits inside the Lock 106. Once the Key Collar 103 passes beyond the Lock Rim 104 the Key 105 may be rotated such that the Protrusion 101 acts as a stopper against the Lock Rim 104. Electrical connections are not shown in FIG. 9.

Figures 10A, 10B:
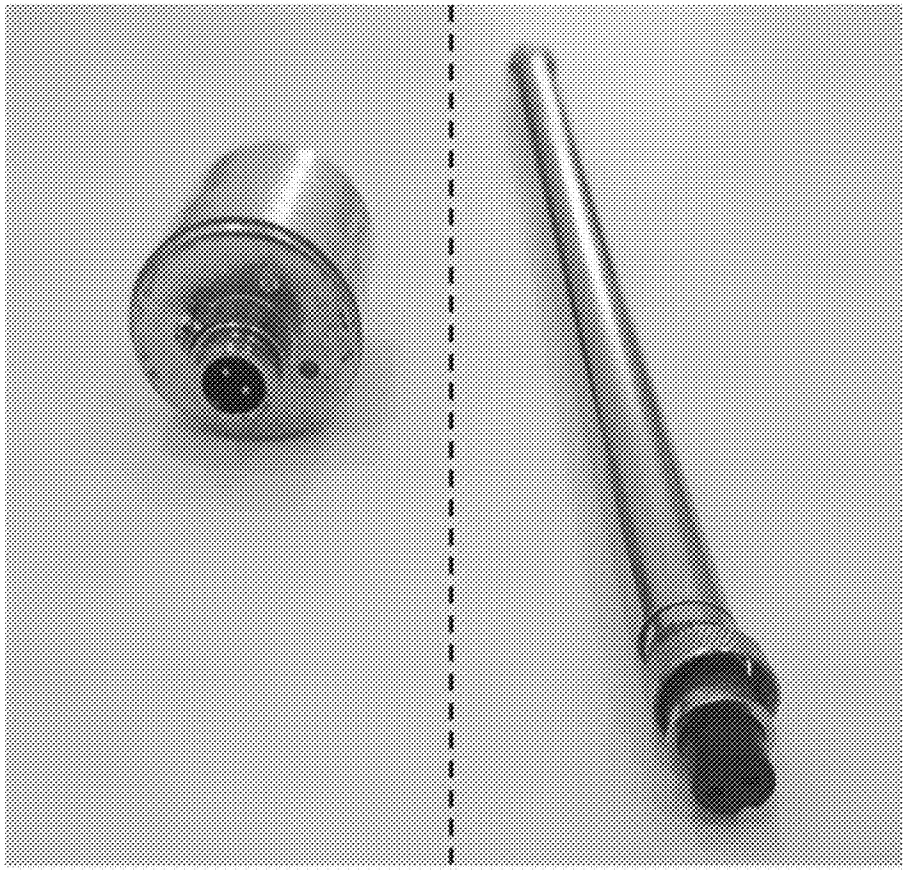
FIG. 10A is a sketch showing one possible element.
FIG. 10B is a sketch showing one possible article.

FIG. 10A is a sketch showing one possible element having a male coupling assembly. The male coupling assembly has: (i) a telescoping coupling inner surface; (ii) an exterior surface with at least one coupling thread; and (iii) two pins electrically connected to internal electrical conductors of the element (the internal electrical conductors are not shown).

FIG. 10B is a sketch showing one possible article. The article has: (i) a telescoping coupling outer surface; (ii) a collar having an inner collar surface with at least one inner collar thread; and (iii) two receptacles electrically connected to internal electrical contacts of the article (the internal electrical contacts are not shown).

Figures 11A, 11B:
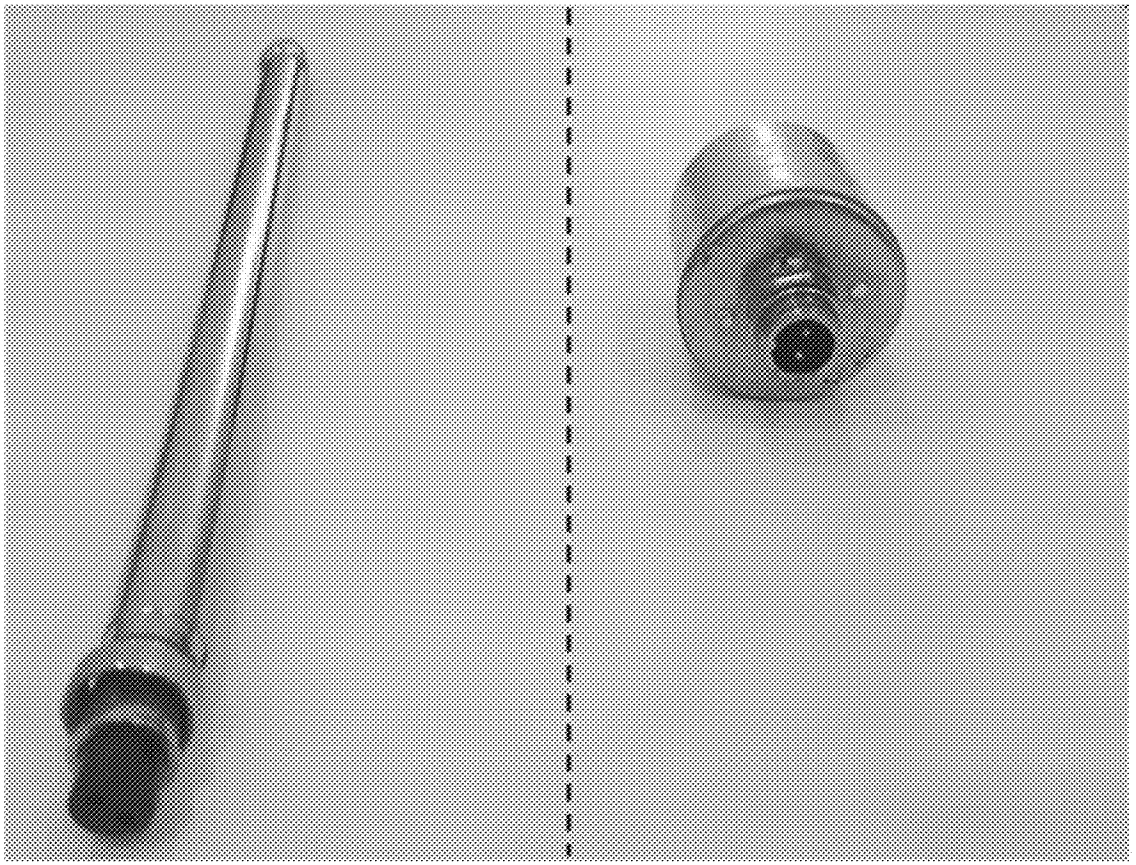
FIG. 11A is a sketch showing one possible element.
FIG. 11B is a sketch showing one possible article.

FIG. 11A is a sketch showing one possible element having a female coupling assembly. The female coupling assembly has: (i) a telescoping coupling outer surface; (ii) a collar having an inner collar surface with at least one inner collar thread; and (iii) two receptacles electrically connected to internal electrical conductors of the element (the internal electrical conductors are not shown).

FIG. 11B is a sketch showing one possible article. The article has: (i) a telescoping coupling inner surface; (ii) an exterior surface with at least one coupling thread; and (iii) two pins electrically connected to internal electrical contacts of the article (the internal electrical contacts are not shown).

The invention claimed is:

1. An element for use in constructing an electrical system having at least one article, said article having at least two electrical contacts and a body, said element comprising:

(i) a housing member having:
  a. a first surface;
  b. a second surface distal from said first surface;
  c. a first line extending through said housing member from said first surface to said second surface; and
  d. a third surface:
    i. extending from said first surface to said second surface; and
    ii. spaced from and not intersected by said first line;

(ii) at least two electrical conductors internal of said third surface, each of said electrical conductors passing through said housing member along second and third lines extending generally along the path of said first line and electrically isolated from said third surface; and (iii) at least one coupling assembly affixed to at least one of said first and second surfaces having:
  a. means for structurally connecting said housing member of said element and said body of said article;
  b. means for detachably locking said housing member of said element to said body of said article;
  c. means for electrically connecting said electrical contacts of said article and said internal electrical conductors of said element;
  d. means for providing a load bearing connection between said housing member of said element and said body of said article in at least one direction of said element relative to said article; and
  e. means for arresting motion of said housing member of said element relative to said body of said article when said element is connected to said article.

2. The element of claim 1 wherein said body of said article comprises a telescoping coupling outer surface and said means for structurally connecting comprises a telescoping coupling inner surface of said coupling assembly of said element, said inner surface dimensionally sized to telescopingly engage with said outer surface.

3. The element of claim 1 wherein said body of said article comprises a telescoping coupling inner surface and said means for structurally connecting comprises a telescoping coupling outer surface of said coupling assembly of said element, said inner surface dimensionally sized to telescopingly engage with said outer surface.

4. The element of claim 1 wherein said body of said article comprises a collar and said means for detachably locking comprises an exterior surface of said coupling assembly with at least one coupling thread, said collar having an inner collar surface with at least one inner collar thread dimensionally sized to engage with said coupling thread.

5. The element of claim 1 wherein said body of said article comprises an exterior surface with at least one coupling thread and said means for detachably locking comprises a collar of said coupling assembly, said collar having an inner collar surface with at least one inner collar thread dimensionally sized to engage with said coupling thread.

6. The element of claim 1 wherein said body of said article comprises at least two receptacles, said receptacles electrically connected to said electrical contacts and said means for electrically connecting comprises at least two pins of said coupling assembly electrically connected to said electrical conductors of said element, said pins dimensionally sized to telescopingly engage with said receptacles.

7. The element of claim 1 wherein said body of said article comprises at least two pins, said pins electrically connected to said electrical contacts of said article and said means for electrically connecting comprises at least two receptacles of said coupling assembly, said receptacles electrically connected to said electrical conductors of said element, said pins dimensionally sized to telescopingly engage with said receptacles.

8. The element of claim 1 wherein said body of said article comprises a telescoping coupling outer surface and a collar, said collar having an inner collar surface with at least one inner collar thread and said means for providing a load bearing connection comprises:

(i) a telescoping coupling inner surface of said coupling assembly of said element dimensionally sized to telescopingly engage with said outer surface of said article; and (ii) an exterior surface of said coupling assembly with at least one coupling thread, said inner collar thread dimensionally sized to engage with said coupling thread of said article.

9. The element of claim 1 wherein said body of said article comprises a telescoping coupling inner surface and an exterior surface with at least one coupling thread and said means for providing a load bearing connection comprises:

(i) a telescoping coupling outer surface of said coupling assembly of said element dimensionally sized to telescopingly engage with said inner surface of said article; and (ii) a collar of said coupling assembly, said collar having an inner collar surface with at least one inner collar thread dimensionally sized to engage with said coupling thread of said article.

10. The element of claim 1 wherein said body of said article comprises a telescoping coupling outer surface and a collar, said collar having an inner collar surface with at least one inner collar thread and said means for arresting motion comprises:

(i) a telescoping coupling inner surface of said coupling assembly of said element dimensionally sized to telescopingly engage with said outer surface of said article; and (ii) an exterior surface of said coupling assembly with at least one coupling thread, said inner collar thread dimensionally sized to engage with said coupling thread of said article.

11. The element of claim 1 wherein said body of said article comprises a telescoping coupling inner surface and an exterior surface with at least one coupling thread and said means for arresting motion comprises:

(i) a telescoping coupling outer surface of said coupling assembly of said element dimensionally sized to telescopingly engage with said inner surface of said article; and (ii) a collar of said coupling assembly, said collar having an inner collar surface with at least one inner collar thread dimensionally sized to engage with said coupling thread of said article.

12. The element of claim 1 further comprising:

(i) said housing member having:

a. a fourth surface;

b. a fourth line extending through said housing member from said fourth surface to said first line; and c. a fifth surface:

i. extending from said fourth surface to said first line; and ii. spaced from and not intersected by said fourth line;

(ii) at least third and fourth electrical conductors internal of said fifth surface, each of said third and fourth electrical conductors passing through said housing member along fifth and sixth lines extending generally along the path of said fourth line and electrically isolated from said exterior surface;

(iii) a parallel electrical connection between said conductors internal of said third surface and said conductors internal of said fifth surface; and (iv) at least one coupling assembly affixed to said fourth surface.

13. The element of claim 1 further comprising at least one adaptor assembly capable of interfacing with a traditional electrical system with the electrical conductors of the adaptor assembly connected to the internal electrical conductors of the coupling assembly.

14. An apparatus comprising at least a first element and a second element:

(i) said first element further comprising:

a. a housing member having:

i. a first surface;

ii. a second surface distal from said first surface;

iii. a first line extending through said housing member from said first surface to said second surface; and iv. a third surface:

(a) extending from said first surface to said second surface; and (b) spaced from and not intersected by said first line;

b. at least two electrical conductors internal of said third surface, each of said electrical conductors passing through said housing member along second and third lines extending generally along the path of said first line and electrically isolated from said third surface; and c. at least one coupling assembly affixed to at least one of said first and second surfaces;

(ii) said second element further comprising:

a. a second housing member having:

i. a first surface;

ii. a second surface distal from said first surface;

iii. a first line extending through said housing member from said first surface to said second surface; and iv. a third surface:

(a) extending from said first surface to said second surface; and (b) spaced from and not intersected by said first line;

b. at least two electrical conductors internal of said third surface, each of said electrical conductors passing through said housing member along second and third lines extending generally along the path of said first line and electrically isolated from said third surface; and c. at least one coupling assembly affixed to at least one of said first and second surfaces; and (iii) means for:

a. structurally connecting said housing member of said first element and said housing member of said second element;

b. means for detachably locking said housing member of said first element to said housing member of said second element;

c. means for electrically connecting said electrical conductors of said first element and said electrical conductors of said second element;

d. means for providing a load bearing connection between said housing member of said first element and said housing member of said second element in at least one direction of said first element relative to said second element; and e. means for arresting motion of said housing member of said first element relative to said housing member of said second element when said first element is connected to said second element.

15. The apparatus of claim 14 wherein:

(i) said body of said first element comprises a telescoping coupling inner surface;

(ii) said body of said second element comprises a telescoping coupling outer surface; and (iii) said means for structurally connecting comprises said inner surface of said first element dimensionally sized to telescopingly engage with said outer surface of said second element.

16. The apparatus of claim 14 wherein:

(i) said body of said first element comprises an exterior surface of said coupling assembly of said first element with at least one coupling thread;

(ii) said body of said second element comprises a collar of said coupling assembly of said second element, said collar having an inner collar surface with at least one inner collar thread; and (iii) said means for detachably locking comprises said exterior surface of said first element dimensionally sized to engage with said inner collar thread of said second element.

17. The apparatus of claim 14 wherein:

(i) said body of said first element comprises at least two pins of said coupling assembly of said first element electrically connected to said electrical conductors of said first element;

(ii) said body of said second element comprises at least two receptacles, said receptacles electrically connected to said electrical conductors of said second element; and (iii) said means for electrically connecting comprises said pins of said first element dimensionally sized to telescopingly engage with said receptacles of said second element.

18. The apparatus of claim 14 wherein:

(i) said body of said first element comprises a telescoping coupling inner surface and an exterior surface with at least one coupling thread;

(ii) said body of said second element comprises a telescoping coupling outer surface and a collar, said collar having an inner collar surface with at least one inner collar thread; and (iii) said means for providing a load bearing connection comprises:
a. said inner surface of said first element dimensionally sized to telescopingly engage with said outer surface of said second element; and
b. said coupling thread of said first element dimensionally sized to engage with said inner collar thread of said second element.

19. The apparatus of claim 14 wherein:
(i) said body of said first element comprises a telescoping coupling inner surface and an exterior surface with at least one coupling thread;
(ii) said body of said second element comprises a telescoping coupling outer surface and a collar, said collar having an inner collar surface with at least one inner collar thread; and
(iii) said means for arresting motion comprises:
a. said inner surface of said first element dimensionally sized to telescopingly engage with said outer surface of said second element; and
b. said coupling thread of said first element dimensionally sized to engage with said inner collar thread of said second element.

20. A method of constructing an electrical system comprising:
(i) selecting at first element comprising:
a. a first housing member having:
i. a first surface;
ii. a second surface distal from said first surface;
iii. a first line extending through said housing member from said first surface to said second surface; and
iv. a third surface:
(a) extending from said first surface to said second surface; and
(b) spaced from and not intersected by said first line;
b. at least two electrical conductors internal of said third surface, each of said electrical conductors passing through said housing member along second and third lines extending generally along the path of said first line and electrically isolated from said third surface; and
c. at least one coupling assembly affixed to at least one of said first and second surfaces having:
i. a telescoping coupling inner surface;
ii. an exterior surface with at least one coupling thread; and
iii. at least two pins electrically connected to said electrical conductors of said first element;
(ii) selecting a second element comprising:
a. a second housing member having:
i. a first surface;
ii. a second surface distal from said first surface;
iii. a first line extending through said housing member from said first surface to said second surface; and
iv. a third surface:
(a) extending from said first surface to said second surface; and
(b) spaced from and not intersected by said first line;
b. at least two electrical conductors internal of said third surface, each of said electrical conductors passing through said housing member along second and third lines extending generally along the path of said first line and electrically isolated from said third surface; and
c. at least one coupling assembly affixed to at least one of said first and second surfaces having:
i. a telescoping coupling outer surface;
ii. a collar, said collar having an inner collar surface with at least one inner collar thread; and
iii. at least two mating receptacles, said mating receptacles electrically connected to said electrical conductors of said second element;
(iii) orienting said first and second elements such that the pins of said first element are in telescoping alignment with said mating receptacles of said second element;
(iv) engaging said telescoping coupling inner surface of said first element with said telescoping coupling outer surface of said second element; and
(v) engaging said coupling thread of said first element with said inner collar thread of said second element.

* * * * *